United States Patent [19]

Headrick

[11] 4,427,045

[45] Jan. 24, 1984

[54] SURGE DAMPENING BAFFLE FOR LIQUID STORAGE TANKS

[76] Inventor: Richard T. Headrick, 5200 Irvine Blvd., #24, Irvine, Calif. 92714

[21] Appl. No.: 435,934

[22] Filed: Oct. 22, 1982

Related U.S. Application Data

[63] Continuation of Ser. No. 211,061, Nov. 28, 1980, abandoned.

[51] Int. Cl.[3] ..... B65D 90/52

[52] U.S. Cl. ..... 150/55; 220/22; 220/85 B; 244/135 B

[58] Field of Search ..... 150/0.5; 220/22, 85 B, 220/85 S; 114/75; 280/5 C, 5 F; 244/135 B

[56] References Cited

U.S. PATENT DOCUMENTS

| | | | |
|---|---|---|---|
| 2,355,084 | 8/1944 | Kurrle | 150/0.5 |
| 2,381,739 | 8/1945 | Gray | 150/0.5 X |
| 2,430,905 | 11/1947 | Bradley | 220/85 B X |
| 3,288,186 | 11/1966 | Headrick | 150/0.5 |
| 3,310,016 | 3/1967 | Lopker | 114/75 |

*Primary Examiner*—William Price
*Assistant Examiner*—Sue A. Weaver
*Attorney, Agent, or Firm*—Jackson, Jones & Price

[57] ABSTRACT

An improved surge dampening baffle adapted to be secured inside of collapsible liquid storage tank (pillow tank) is disclosed. The improved baffle comprises several plies of a suitable fabric. The improved baffle is flexible and collapsible; yet readily repairs and retains its shape after a distortion so as to substantially always provide alternatively disposed hollow truncated and tapered convolutions which are instantaneously available to dampen a developing surge of a liquid stored in the pillow tank.

10 Claims, 8 Drawing Figures

FIG. 1
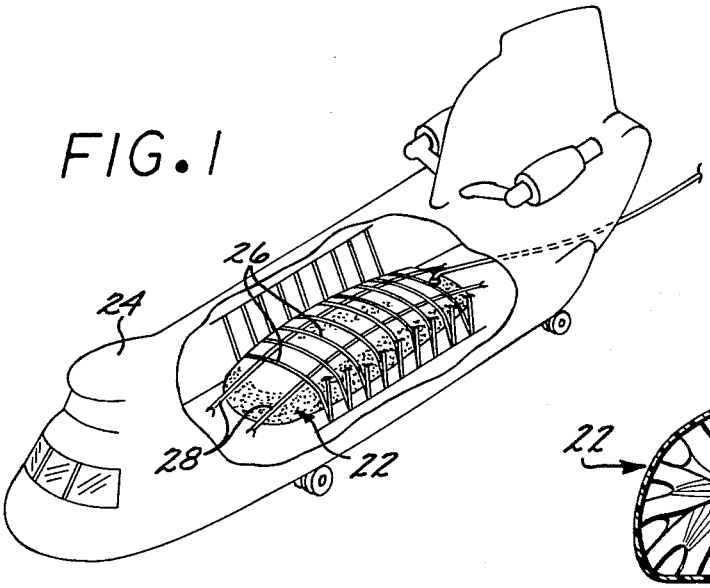
FIG. 2
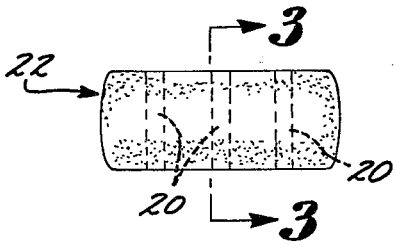
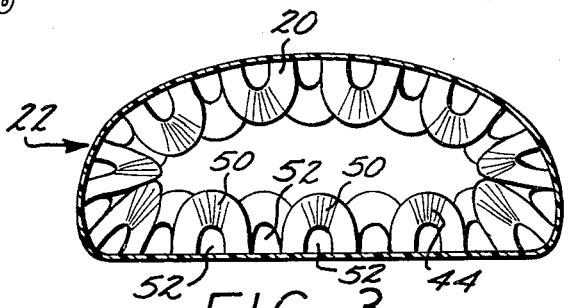
FIG. 3
FIG. 5
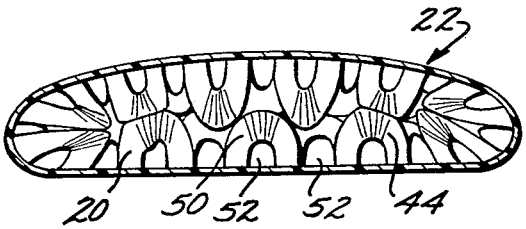
FIG. 4
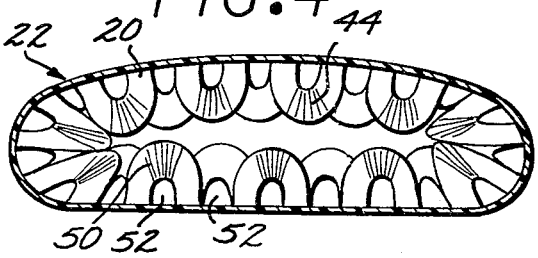
FIG. 7
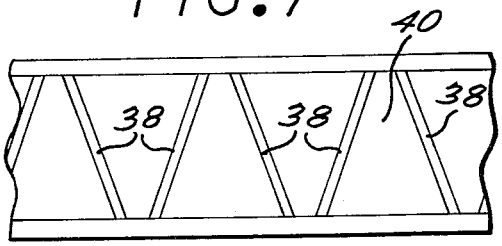
FIG. 6
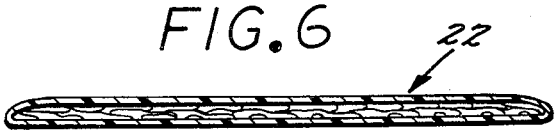
FIG. 8
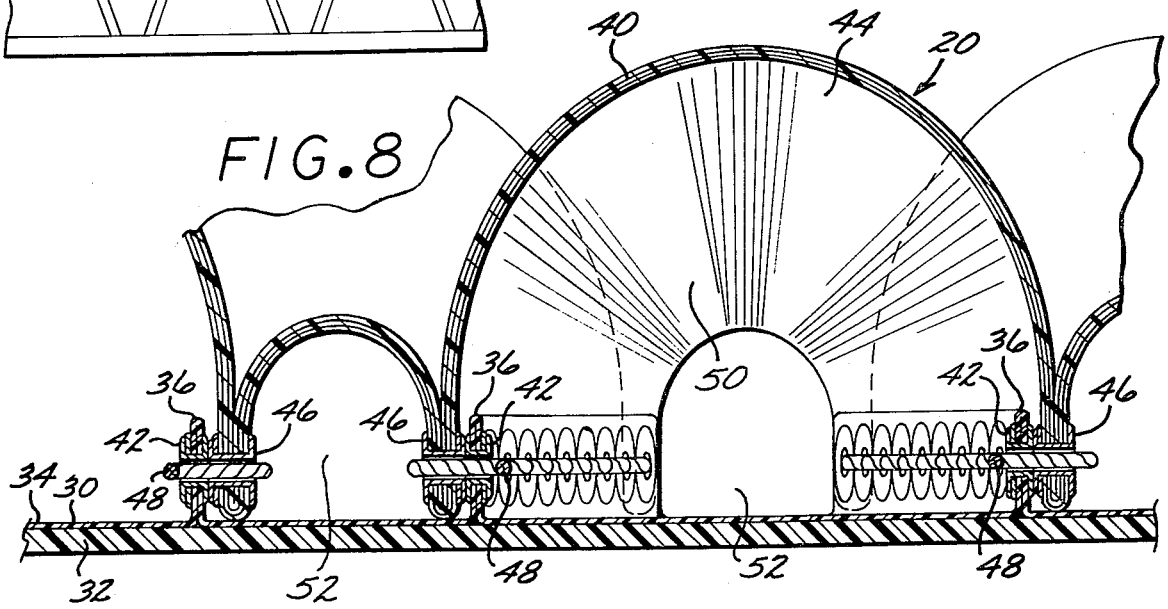

SURGE DAMPENING BAFFLE FOR LIQUID STORAGE TANKS

This is a continuation, of application Ser. No. 211,061, filed Nov. 28, 1980 and now abandoned.

BACKGROUND OF THE INVENTION

1. Field of the Invention

The present invention is directed to an improved surge attenuating baffle for collapsible liquid storage tanks, and more particularly, to an improved baffle for collapsible liquid storage tanks which provide substantially instantaneous surge attenuation as soon as a surge of liquid is in development in the storage tank.

2. Description of the Prior Art

Pillow tanks, i.e., collapsible self-supporting and transportable storage tanks, have been used for a long time in land based installations. Pillow tanks are usually fabricated from rubberized fabric or like material. A principal advantage of the pillow tanks is that, when empty, they are relatively light-weight and, therefore, are readily transportable, particularly in a rolled-up state.

For a long time, however, transportation of a pillow tank partially or entirely filled with a liquid presented an almost insurmountable problem because of surges developing in the liquid contained in the tank. The surges in the transported liquid are invariably occasioned by the acceleration or deceleration of the vehicle transporting the pillow tank. As it is readily appreciated by those skilled in the art, liquid surges which may develop in a pillow tank transported in a truck and particularly in an aircraft, if unattenuated, may reach destructive proportions. Experience has shown that substantially unattenuated surges of liquid developing in a pillow tank transported in an aircraft may even lead to total loss of control and resultant crash of the aircraft.

U.S. Pat. No. 3,288,186 in its introductory portion describes in detail the difficulties encountered in the prior art in attempting to adapt pillow tanks for transportation and especially airborne transportation of liquids. The introductory portion of that patent disclosure explains that surges in the liquid reach particularly dangerous proportions when a transported pillow tank is in a partially empty state.

As a solution to the above summarized problem, U.S. Pat. No. 3,288,186 discloses a surge attenuating baffle and pillow tank combination which finally rendered possible the airborne transportation of liquids in full, and more importantly, in partially filled pillow tanks. As is readily appreciated, airborne transportation of liquids such as hydrocarbon fuels in partially filled containers has special importance in certain types of military operations wherein, e.g. several bases must be supplied with varying amounts of fuel from the same pillow tank.

Briefly, the baffle disclosed in U.S. Pat. No. 3,288,186 comprises a plurality of flexible, elongated, tapered pockets having opposite open ends. The pockets are disposed with their respective elongate extents substantially parallel with the direction of the surge of liquid in an elongate pillow tank. A base strip is directly secured circumferentially to the interior surface of the pillow tank transversely to the length of the tank. A baffle strip is then secured by grommets and laces to the base strip along regularly spaced alternatively converging and diverging lines on the base strip so that the pockets in their fully extended state have subtantially semicircular cross sections.

The baffle strip of the device described in U.S. Pat. No. 3,288,186 is a flexible strip made of a single sheet or single ply of suitable rubberized material. The flexible baffle strip allows the pillow tank to collapse when liquid is withdrawn from the tank, and even permits storage of the pillow tank in a substantially flat or "rolled-up" state.

Although the baffle strip of U.S. Pat. No. 3,288,186 has been successfully used for several years for airborne transportation of fuel, it has a disadvantage in that the pockets or convolutions which attenuate the liquid surges in the tank, are usually in a collapsed state when the liquid is at rest in the tank. Therefore, at least some initial movement of the surging liquid is required before the baffle reaches its intended "multiple-pocket" like configuration and becomes effective in attenuating the surge of the liquid in the tank.

In summary, the baffle disclosed in U.S. Pat. No. 3,288,186 works well. Nevertheless, its less than instantaneous ability to attenuate a developing surge has placed an upper limit on the size of transportable and particularly airborne pillow tanks which may be built in accordance with the teachings of U.S. Pat. No. 3,288,186. Generally speaking, it was thought to be unpractical to build transportable pillow tanks capable of holding more than approximately three thousand gallons of liquid. As an improvement over the teachings of U.S. Pat. No. 3,288,186, the present invention provides a baffle having instantaneous surge attenuating ability and, therefore, renders possible the manufacture of larger than three thousand gallon pillow tanks and transportation of liquids in the same.

OBJECTS AND SUMMARY OF THE INVENTION

It is an object of the present invention to provide a collapsible pillow tank for airborne and like transportation of liquids and having an improved baffle adapted for substantially instantaneous attenuation of surges in the liquid.

It is another object of the present invention to provide an improved baffle for collapsible pillow tanks which has improved surge attenuating capability and which is adapted for incorporation into certain existing pillow tanks constructed in accordance with the disclosure of U.S. Pat. No. 3,288,186.

These and other objects and advantages are attained by a baffle which includes an elongated baffle strip adapted to be secured to the interior of a collapsible liquid storage tank. The baffle strip is disposed in the tank substantially transversely to the direction of a surge of the liquid in the tank and is gathered in the direction of its length to define a plurality of hollow, truncated and tapered convolutions which extend into the interior of the tank. Alternate convolutions have their respective large ends opening at opposite edges of the baffle strip.

The baffle strip is made of a material which is flexible so as to allow collapse of the tank upon withdrawal of the liquid therefrom. The material of the baffle strip is, however, substantially shape retaining so that the hollow, truncated and tapered convolutions are present in the tank even when the liquid in the tank is at rest. Because of the presence of the convolutions a developing surge is rapidly attenuated without the need for the surge to first inflate the convolutions so as to become effective for attenuation of the same.

The objects and features of the present invention are set forth in the appended claims. The present invention may be best understood by reference to the following description taken in connection with the accompanying drawings in which like numerals indicate like parts.

BRIEF DESCRIPTION OF THE DRAWINGS

FIG. 1 is a schematic, perspective view of a cargo helicopter with parts broken away, the view showing a pillow tank secured in the helicopter;

FIG. 2 is a plan view of a pillow tank showing how a plurality of baffles constructed in accordance with the present invention are incorporated in the pillow tank;

FIG. 3 is a schematic cross-sectional view of a pillow tank being substantially filled with liquid, and incorporating the improved baffle of the present invention; the view being taken on lines 3—3 of FIG. 2;

FIG. 4 is a schematic, cross-sectional view similar to the view of FIG. 3, and differing therefrom only in that the pillow tank is less than full with liquid;

FIG. 5 is a schematic, cross-sectional view similar to the view of FIG. 4 and differing therefrom only in that the pillow tank contains still less liquid;

FIG. 6 is a schematic cross-sectional view similar to the view of FIG. 5, and differing therefrom in that the view shows the pillow tank after substantially all liquid has been removed therefrom;

FIG. 7 is a partial, top plan view of the improved baffle of the present invention, and FIG. 8 is a cross-sectional, partial view of the baffle of the present invention, the view showing in detail the attachment of a baffle strip to a base strip.

DESCRIPTION OF THE PREFERRED EMBODIMENT

The following specification taken in conjunction with the drawings sets forth the preferred embodiment of the present invention. The embodiment of the invention disclosed herein is the best mode contemplated by the inventor for carrying out his invention in a commercial environment, although it should be understood that various modifications can be accomplished within the parameters of the present invention.

Referring now to the drawing figures and particularly to FIGS. 3–6 and 8, a preferred embodiment of the improved surge attenuating baffle 20 of the present invention is disclosed. It should be noted at the outset that a pillow tank 22 constructed in accordance with the present invention is similar in many respects to the pillow tank described in U.S. Pat. No. 3,288,186, the specification of which is hereby expressly incorporated by reference.

The improved baffle 20 of the present invention also has many similarities to the baffle disclosed in U.S. Pat. No. 3,288,186. Nevertheless, the novel construction of the improved baffle 20 comprises the principal novel feature of the present invention. In light of the foregoing, the baffle 20 and the pillow tank 22 incorporating the baffle 20 is described here in detail only with particular emphasis on the novel features of the baffle 20. Standard or non-novel features of the baffle 20 and of the pillow tank 22 are described here only to the extent necessary for understanding the present invention.

Thus, the pillow tank 22 is made of rubberized fabric or like material which is impervious to and compatible with the liquid stored and transported in the pillow tank 22.

In most applications, and particularly in most airborne uses of the pillow tank 22, gasoline or a like hydrocarbon fuel is transported in the pillow tank 22. Therefore, in the ensuing description, the liquid transported in the pillow tank is generally referred to as gasoline or fuel, although it should be understood that the present invention is not limited by the type of liquid which may be transported in the pillow tank 22.

The pillow tank 22 built in accordance with the present invention can be secured to an aircraft such as the cargo helicopter 24 shown in FIG. 1. The pillow tank 22 can be secured to the helicopter 24 in the same manner as the prior art pillow tank described in U.S. Pat. No. 3,288,186. Thus, a plurality of lateral tie-down straps 26 extending transversely to the elongate tank 22, and a plurality of longitudinal tie-down straps 28 secure the tank 22 to the helicopter 24.

The pillow tank 22, in accordance with the present invention and also with the prior art, usually incorporates more than one baffle 20. The improved baffle 20 of the present invention in many respects has the same general configuration as the baffle described in U.S. Pat. No. 3,288,186. The improved baffle 20 is best shown on FIGS. 3–6 and in most detail on FIG. 8. Thus, the improved baffle 20 preferably comprises a base strip 30 which is usually made of rubberized fabric. The base strip 30 is secured circumferentially to the inner wall 32 of the elongate pillow tank 22 in such a manner that the base strip 30 is disposed substantially transversely to the principal direction of surge action of the fuel in the elongate tank 22. The base strip 30 is most advantageously secured to the inner wall 32 of the pillow tank 22 by a suitable adhesive (not shown).

The base strip 30 includes several relatively narrow portions which are elevated relative to the surface 34 of the base strip 30 and wherein the fabric of the base strip 30 is folded upon itself so as to form a T-shaped configuration or protrusion 36. The T-shaped protrusions 36 of the base strip 30 are best shown on the cross-sectional view of FIG. 8.

The T-shaped protrusions 36 are incorporated into the base strip 30 in a predetermined configuration along regularly spaced lines which alternately converge and diverge relative to one another. The spacing of the lines is best discernible on the top plan of view of FIG. 7 wherein the alternating spaced, double lines show a portion 38 of an improved baffle strip 40 which is secured to the T-shaped protrusions 36 of the base strip 30.

The T-shaped protrusions 36 are provided with a plurality of grommets 42, shown on FIG. 8. The purpose of the grommets 42 is to secure the improved baffle strip 40 to the base strip 30 in such a manner that the baffle strip 40 forms a plurality of open-ended pockets or convolutions 44 which extend into the interior of the pillow tank 22. A plurality of grommets 46 are also incorporated into the baffle strip 40 in areas where the baffle strip 40 is folded upon itself in a predetermined configuration of the T-shaped protrusions 36 of the base strip 30. The baffle strip 40 is then conveniently secured to the base strip 30 by lacing the respective plurality of grommets 42 and 46 to one another by a suitable lace or rope 48, as is shown on FIG. 8.

Because of the particular configuration of the T-shaped protrusions 36 on the base strip 30 and of the complementary lay-out of the grommets 46 on the baffle strip 40, the pockets or convolutions 44 in the assembled baffle 20 are substantially aligned with their respective elongate extents with the principal direction of surge action in the pillow tank 22, i.e. with the general longitudinal axis of the tank 22.

Furthermore, the pockets or convolutions 44 each have a larger opening 50 and a smaller opening or restriction 52 at their respective opposite ends. The respective larger openings 50 and restrictions are alternately disposed in a "forward" and "backward" direction with regard to the general longitudinal axis of the pillow tank 20.

For a more detailed description of the lay-out of the predetermined geometrical areas where the base strip 30 and the baffle strip 40 are attached to one another, reference is made to the specification of U.S. Pat. No. 3,288,186.

As is described in detail in U.S. Pat. No. 3,288,186, the baffle 20 in the pillow tank 22 is effective in attenuating surges of the liquid contained in the tank 22 because a surge of the liquid, whether it is moving in a forward or backward direction in the tank 22, must pass through the pockets or convolutions 44. Half of the pockets of convolutions 44 always present their respective larger openings 50 to the incoming surge. The liquid must then pass through the smaller openings or restrictions 52 of the pockets 44. In the process, a large portion of the energy of the surge is transferred to the baffle 20. The improved baffle 20 of the present invention, as well as the baffle disclosed in U.S. Pat. No. 3,288,186, is most effective for attenuating surges when the pillow tank 22 is approximately half-filled with liquid. As is well known in the art, this is the state of the tank 22 when the surges in the liquid are most powerful and can reach the most destructive proportions.

A principal novel feature and advantage of the present invention is in the construction of the baffle strip 40. The baffle strip 40 is constructed to be collapsible and flexible and yet capable of substantially regaining its truncated, substantially conical shape after it has been distorted by the collapsing walls of the pillow tank 22. In other words, when the pillow tank 22 is again fully or partially filled with liquid after it has been in an empty, collapsed state, the baffle strip 40 substantially regains its original shape regardless of surges actually occurring in the tank 22.

FIGS. 3, 4, 5 and 6 of the drawings show that because of the shape-retaining elastic nature of the improved baffle strip 40 of the present invention, the pockets or convolutions 44 are substantially always in the maximum possible extended or "upright" position permitted by the particular status of tank 22.

More particularly, FIG. 6 shows the tank 22 in a substantially empty and collapsed state as a result of fuel having been evacuated therefrom under the vacuum. In this state the baffle strip 40 is also collapsed. FIGS. 5, 4 and 3 show the pillow tank 22 containing progressively larger and larger volumes of fuel. FIGS. 5, 4 and 3 also show the pockets or convolutions 44 progressively reaching their fully expanded positions as a result of the shape regaining and retaining nature of the material from which the baffle strip 40 is fabricated.

The above-described feature is in sharp contrast with the baffles of the prior art, and particularly the baffle disclosed in U.S. Pat. No. 3,288,186. The baffle of U.S. Pat. No. 3,288,186 is substantially collapsed when the liquid is at rest in the pillow tank. Therefore, the baffle of U.S. Pat. No. 3,288,186 is not instantaneously available to attenuate a developing surge. Instead, it requires at least some activation by the surge itself to become "inflated" and effective to dampen the surge.

The improved baffle 20 of the present invention, on the other hand, is substantially always in its maximum possible extended position. Therefore, the pockets or convolutions of the improved baffle 20 are instantaneously available to dampen or attenuate a developing surge before the surge becomes well developed. In fact, the enhanced surge attenuating ability of the improved baffle 20 of the present invention renders possible the manufacture and transportation of collapsible pillow tanks having substantially larger than three thousand gallon capacity.

In order to have its requisite shape regaining and yet flexible properties, the improved baffle strip 40 of the present invention is preferably manufactured from several plies or layers of rubberized Nylon, Dacron or similar fabric. The several layers or plies of the suitable rubberized fabric are manufactured and attached to one another on a suitable form (not shown) having a shape which causes the baffle strip 40 to attain the configuration shown on FIGS. 3 and 8 of the present description. As is well understood by those skilled in the rubber manufacturing and related arts, the "multi-ply" construction of the rubberized baffle strip 40 causes the baffle strip 40 to have a "memory" and be "desirous" of regaining its original shape into which it was manufactured on the form (not shown).

FIG. 8 shows a baffle strip 40 constructed in accordance with the present invention which comprises 3 layers or plies of a rubberized fabric. It should be expressly understood however, that the exact number of layers or plies comprising the improved baffle strip 40 is not critical. Neither is critical the exact nature of the material from which the layers or plies of the improved baffle strip 40 are made. What is critical for the purposes of the present invention is that the baffle strip 40 be flexible and capable of substantially regaining its original shape as the tank is filled and expands in volume. Furthermore, the baffle strip 40 must be sufficiently strong so as to be capable of absorbing energy of the developing surges. The baffle strip 40, of course, also must be compatible with the liquid stored in the tank 22.

Although several layers or plies of rubberized Dacron or Nylon fabric well satisfy the above-noted requirements, other materials may become available for the manufacture of the improved baffle strip 40. For the aforestated reasons, the exemplary description of the present specification should not be construed to limit the scope of the present invention. Instead, the scope of the present invention should be ascertained solely from the following claims.

What is claimed is:

1. An improved apparatus for storing liquid comprising: a flexible and collapsible tank adapted to contain liquid therein and a plurality of elongated pockets secured to the interior surface of the tank, said pockets, when the tank is collapsed, being in a collapsed state and, when the tank is filled with liquid but at rest, being also in a collapsed state, the improvement comprising said pockets, being made of a flexible material having a memory for retaining its shape so that the pockets in the tank are configured in a predetermined substantially permanent shape, said substantially permanent shape of the pockets being substantially distorted only when the tank is collapsed upon the pockets due to withdrawal of liquid from the tank, the pockets being arranged along a line extending transversely of a line along which surges in the liquid contained in the tank move, the pockets having their elongate extents aligned with the line of surge action, each pocket having an enlarged open end and a restriction spaced from the enlarged open end at an opposite end of the pocket, adjacent pockets having their respective open ends and the restrictions arranged to face in opposite directions along the line of surge action, due to the substantially permanent shape of the pockets the pockets being capable of absorbing at least a portion of the energy of the liquid flowing in the surge substantially immediately upon occurrence of the surge to transfer energy from the liquid to the tank.

2. The improved apparatus of claim 1 wherein the pockets comprise multi-ply fabric material adapted to be compatible with the liquid stored in the tank.

3. The improved apparatus of claim 1 wherein the material of the pockets comprises at least two plies of a fabric which is compatible with the liquid stored in the tank and which is memory-retaining because of its construction from at least two plies.

4. The improved apparatus of claim 1 wherein the pockets comprise a base strip secured to the interior surface of the tank along the line transverse to the line of surge action, and a baffle strip secured to the base strip along regularly spaced lines which converge and diverge relative to one another so that the pockets have the shape of hollow truncated cones.

5. The improved apparatus of claim 4 wherein the base strip includes a plurality of grommets, the baffle strip includes a plurality of grommets and the base strip and the baffle strip are secured to one another by lacing the respective grommets of the base strip and the baffle strip with a rope which is compatible with the liquid stored in the tank.

6. An improved apparatus for storing liquids and having an improved capability of attenuating surges in the liquid, an elongated collapsible pillow tank, and pockets which, when the tank is collapsed are in a collapsed state and, when the tank is filled with liquid but at rest are also in a collapsed state, the improvement comprising said pockets being made of an elongated flexible yet substantially shape-retaining baffle strip made of at least two plies of a fabric compatible with the liquid stored in the tank, the baffle strip being secured to the interior of the tank and extending substantially transversely of the direction of the surge, the baffle strip being gathered on itself in the direction of its length to define a plurality of hollow truncated tapered convolutions extending into the interior of the tank, with alternate ones of the convolutions having the large ends thereof substantially at opposite edges of the baffle strip, the convolutions having their substantially permanent shape regardless of surge activity in the liquid and being substantially flattened only as the tank collapses due to withdrawal of liquid from the tank whereby the convolutions comprise means for absorbing at least a portion of the energy of any surge of liquid in the tank substantially immediately upon occurrence of the surge.

7. The apparatus of claim 6 having at least two baffle strips secured to the interior surface of the tank in substantially parallel configuration and at a predetermined distance from one another.

8. The apparatus of claim 6 wherein a base strip is secured to the interior surface of the tank, said base strip extending substantially transversely of the direction of the surge and wherein the baffle strip is secured to the base strip.

9. The apparatus of claim 8 wherein the baffle strip incorporates a plurality of grommets, the base strip incorporates a plurality of grommets, the grommets of the base strip and of the baffle strip are arranged in a predetermined configuration so that as the grommets of the base strip and of the baffle strip are laced to one another, the plurality of hollow truncated, tapered shape-retaining convolutions are formed.

10. The apparatus of claim 9 wherein the baffle strip comprises at least two plies of rubberized fabric and wherein a fibrous material comprising the fabric is a synthetic fiber compatible with the liquid stored in the tank.

* * * * *